United States Patent [19]

Kent et al.

[11] 4,018,377

[45] Apr. 19, 1977

[54] COMPARTMENTED TRAY HAVING IMPROVED DIVIDER MEANS

[75] Inventors: Ronald I. Kent, Whittier; Albert R. Brown, Hughson, both of Calif.

[73] Assignee: Continental Can Company, Inc., New York, N.Y.

[22] Filed: Apr. 8, 1976

[21] Appl. No.: 675,044

[52] U.S. Cl. ..... 229/27

[51] Int. Cl.² ..... B65D 5/48

[58] Field of Search ..... 229/27, 28

[56] References Cited

UNITED STATES PATENTS

| | | | |
|---|---|---|---|
| 2,346,206 | 4/1944 | Broderick | 229/27 |
| 3,055,572 | 9/1962 | Crane | 229/27 |
| 3,127,086 | 3/1964 | Crane | 229/27 |
| 3,194,472 | 7/1965 | Crane | 229/27 X |

FOREIGN PATENTS OR APPLICATIONS

| | | | |
|---|---|---|---|
| 678,626 | 1/1964 | Canada | 229/27 |

*Primary Examiner*—Davis T. Moorhead
*Attorney, Agent, or Firm*—H. Lawrence Smith; Joseph E. Kerwin; William A. Dittmann

[57] ABSTRACT

A tray having at least two compartments is erected from a blank and comprises a bottom wall, a pair of opposed side walls, a pair of opposed end walls and an improved divider separating adjacent compartments. The divider comprises a center panel disposed above the bottom wall and bridging the side walls, a pair of lateral panels extending downwardly to the bottom wall from opposite sides of the central panel, a base provided by a pair of flaps each extending from one of the lateral panels, and a pair of locating tabs each projecting from one of the lateral panels and received in a respective one of a pair of locating slots formed in the bottom wall. The base provided by the flaps is located between the lateral panels. A blank for forming the tray is also disclosed.

18 Claims, 4 Drawing Figures

COMPARTMENTED TRAY HAVING IMPROVED DIVIDER MEANS

BACKGROUND OF THE INVENTION

This invention relates to an open-topped box or tray formed from a blank and having at least two compartments, and more particularly, to such a box or tray having improved divider means.

In recent years it has become a widespread practice to pack and market small fresh fruits such as strawberries and cherry tomatoes in openwork plastic baskets. The filled baskets are, in turn, conventionally shipped and stored in open-topped shallow boxes or trays which may also be suitable for display of the produce by the retailer. The trays are customarily formed from a single blank of double-faced corrugated fibreboard.

While such trays comprise essentially a bottom wall, a pair of opposed side walls and a pair of opposed end walls, they are handled most efficiently in pallet-load units and may otherwise be stacked to substantial heights. To provide the vertical compressive strength necessary for such handling and stacking, and to enhance the rigidity of the tray, the end walls are reinforced, and a relatively sturdy divider is provided intermediate the end walls. The divider also partitions the interior of the tray into two compartments.

The divider conventionally comprises a central panel disposed above the bottom wall and bridging the side walls. A pair of lateral panels extend downwardly to the bottom wall from opposite sides of the central panel. Each of a pair of base flaps extends from a respective one of the lateral panels at a lower side thereof adjacent to the bottom wall. A pair of locating tabs each project from a respective one of the lateral panels at the lower side thereof, the locating tabs being received in a corresponding pair of locating slots formed in the bottom wall. The base flaps are normally fastened to the bottom wall, as by means of an adhesive. This secures the elements of the divider in position and acts to prevent the bottom wall from sagging under the weight of the fruit.

It is important to note that in conventional trays the base flaps extend away from one another and consequently lie on either side of the divider. They are therefore exposed to view when the tray is empty and they obtrude into the respective compartments along the bottom wall. Accordingly, baskets placed adjacent to the divider rest partially on the base flaps and are thereby elevated or tilted relative to the bottom wall. This gives an unstable and uneven appearance to the display of baskets.

More importantly, however, the cut edge of the base flap is exposed to the adjacent baskets. Portions of the fruit which protrude through the interstices at the bottoms of the baskets as a result of the elevation or tilting thereof are bruised or lacerated by the corner of the exposed edge, thereby threatening customer acceptance and satisfaction. Harm to the fruit is aggravated by the relative movement, however slight, which normally occurs between the base flaps and adjacent baskets during handling of the tray. In the case of succulent fruits, bleeding frequently follows, to the additional dismay or annoyance of the party in possession.

SUMMARY OF THE INVENTION

In accordance with the present invention, the base flaps extend from the respective lateral panels toward, rather than away from, one another. They thereby provide a base of the divider which is disposed between the lateral panels. With this construction the base flaps and their edges are precluded from contact with the baskets and the fruit, the divider presents a neater appearance, and the bottom wall is uncluttered within the compartments.

These and other features, objects and advantages of the invention will be apparent from the ensuing description taken in conjunction with the accompanying drawings.

THE DRAWINGS

THE PREFERRED EMBODIMENT

Figure 1:
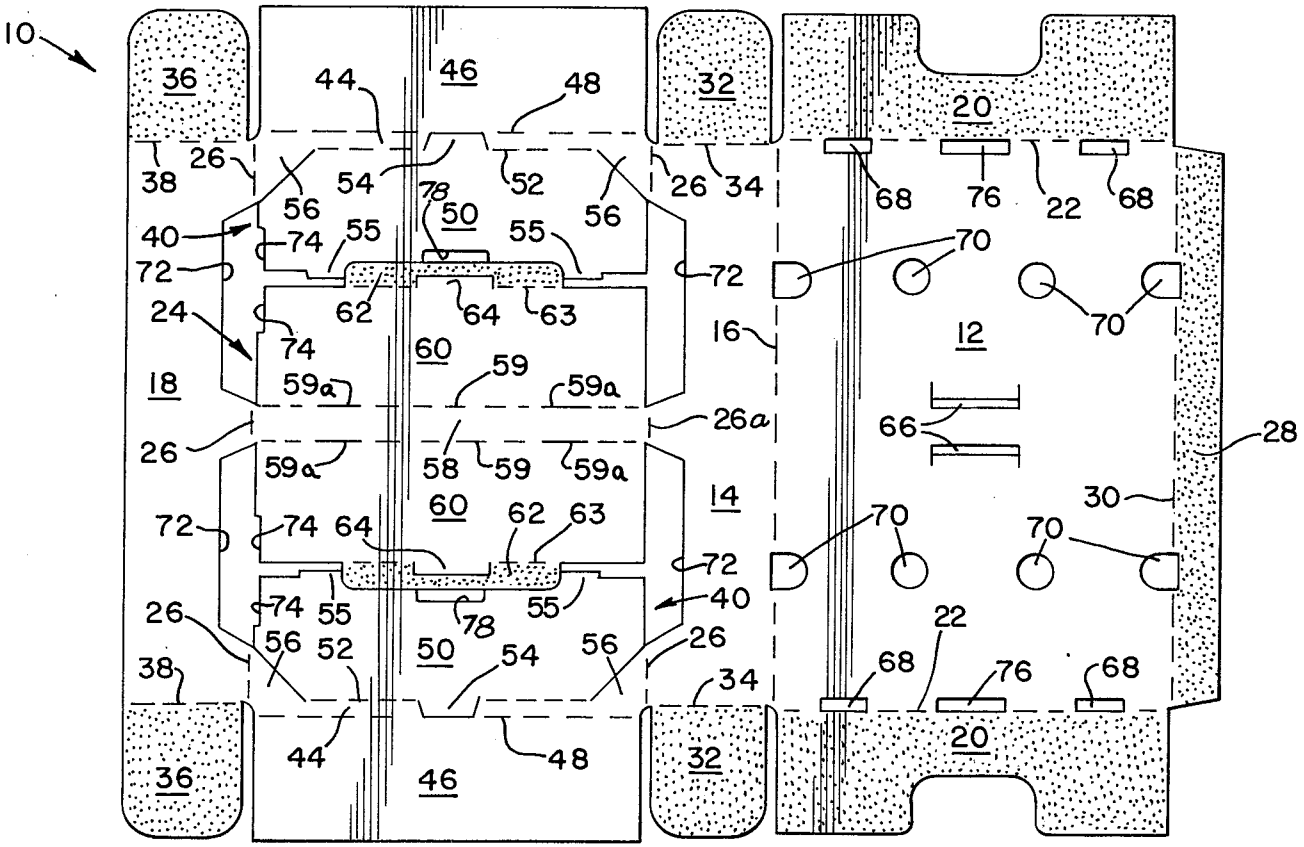
FIG. 1 is a plan view of one face of a blank formed in accordance with the invention.

Referring particularly to FIG. 1, there is shown one face of a blank 10 which is constructed in accordance with the invention and which is preferably formed from a single piece of material, as shown. The material is suitably double-faced corrugated fibreboard; however, any other suitable, substantially rigid but foldable material may be employed. The opposite face of the blank, not visible in FIG. 1, is a mirror image of the one shown, except that the stippling is absent, the stippled elements being those to which adhesive is normally applied.

Blank 10 comprises a plurality of panels, adjacent ones of which are hingedly interconnected. The panels are provided essentially by a bottom panel 12; a first side panel 14 adjacent to one side of the bottom panel and separated therefrom by a score line 16 which is represented by an interrupted line, as are all score lines in FIG. 1; a second side panel 18 spaced from the first side panel; a pair of intermediate end panels 20 spaced from one another which are adjacent to opposite ends of the bottom panel and separated therefrom by score lines 22; and a divider panel means 24 bridging side panels 18 and 14 and separated therefrom by score lines 26 and **26*a***, respectively.

Disregarding the divider panel means for the moment, it will be apparent that with the structure described thus far, a relatively flimsy tray or shallow box might be constructed by folding the blank appropriately and by employing gummed tape or the like to fasten side panel 18 to bottom panel 12 and to fasten intermediate end panels 20 to sidewalls 14 and 18. However, to enhance the vertical compressive strength of the tray, to facilitate stacking, and to provide ease and convenience in erecting the tray, additional features are preferably provided as follows.

A side flap 28 extends from a side of bottom panel 12 opposite side panel 14 and is separated from the bottom panel by a score line 30. A pair of end flaps 32 extend from opposite ends of side panel 14 and are separated therefrom by score lines 34. Similarly, a pair of end flaps 36 extend from opposite ends of side panel 18 and are separated therefrom by score lines 38. A pair of end panel structures 40 bridge side panels 18 and 14 and are separated therefrom by score lines 26 and 26*a*, respectively.

Each end panel structure 40 includes an upper end panel 44, an outer end panel 46 extending outwardly from the upper end panel at one side thereof and separated therefrom by a score line 48, and an inner end panel 50 extending inwardly from the upper end panel at a second side thereof opposite the outer end panel and separated from the upper end panel by a score line 52. A pair of stacking tabs 54 may be provided for a purpose made clear hereinafter, each stacking tab projecting from that side of inner end panel 50 adjacent to upper end panel 44 and interrupting the latter as well as score lines 48 and 52, whereby folding along the latter score lines is facilitated. Each inner end panel 50 has a pair of locking tabs 55 projecting from a side thereof opposite the respective upper end panel. Each upper end panel 44 has at either end thereof a generally triangular brace area 56.

Returning now to divider panel means 24, a central panel 58 thereof bridges side panels 18 and 14 and is separated from them by score lines 26 and 26*a*, respectively. Extending from opposite sides of the central panel, and separated therefrom by score lines 59, is a pair of lateral panels 60. Score lines 59 may include cut segments 59*a* to assist folding of the lateral panels relative to the central panel. A pair of base flaps 62 each hingedly extend from a respective one of lateral panels 60 at a side thereof opposite central panel 58. Score lines 63 separate the base flaps from the lateral panels. Projecting from the same side of each lateral panel is a locating tab 64 which in the embodiment shown comprises a cutout portion of the respective base flap 62, thereby interrupting score line 63 to facilitate folding. Bottom panel 12 has formed therein a pair of locating slots 66 spaced from one another, each of which is disposed and dimensioned to receive a respective one of locating tabs 64 when a tray is erected from the blank, as will be described with greater particularity hereinafter. Also formed in bottom panel 12 are two pairs of locking slots 68, each pair being located adjacent to one of score lines 20 and preferably interrupting the same to facilitate folding. The locking slots are situated and dimensioned to receive locking tabs 55 when the tray is erected.

It is pointed out that elements of the blank lying on either side of any one of the score lines are folded or relatively rotated about that score line in directions away from the viewer with reference to FIG. 1. Since this manner of folding applies to all score lines, it is an important departure from previously known constructions, in which the base flaps of the divider are rotated relative to the lateral panels in directions toward the viewer.

In erecting a tray from blank 10, conventional procedure is followed, except in the formation of the divider, and need be described only briefly as follows.

Adhesive is applied to at least a portion of side flap 28, which is folded back about score line 30 until it lies flat on the opposite face of bottom panel 12. The blank is then folded flatly in half about score line 26*a* to adhere side flap 28 to the opposite face of side panel 18, thereby forming a manufacturer's joint, this much preparation normally being carried out by the producer of the blank.

This, the knocked-down form of the tray, is of such shape and dimensions that it is easily handled during shipment and storage, and it occupies little space relative to its bulk. Handling is also assisted by the fact that, due to its increased thickness, it is more rigid than the unfolded blank.

When the tray is to be erected, adhesive is applied to intermediate end panels 20, end flaps 32 and 36, and base flaps 62. The knocked-down tray is opened or expanded to a rectangular tubular form, thereby creasing it at score lines 16 and 26 as well as the previously creased score lines 26*a* and 30. End flaps 32 and 36 are folded inwardly about score lines 34 and 38, respectively, and intermediate end panels 20 are folded inwardly about score lines 22 to adhere the opposite face of each to the adjacent ones of end flaps 32 and 36.

Outer end panels 46 are folded inwardly about score lines 48 to adhere the opposite face of each to the adjacent one of intermediate end panels 20. Inner end panels 50 are folded about score lines 52 until locking tabs 55 are securely received in locking slots 68.

Figure 2:
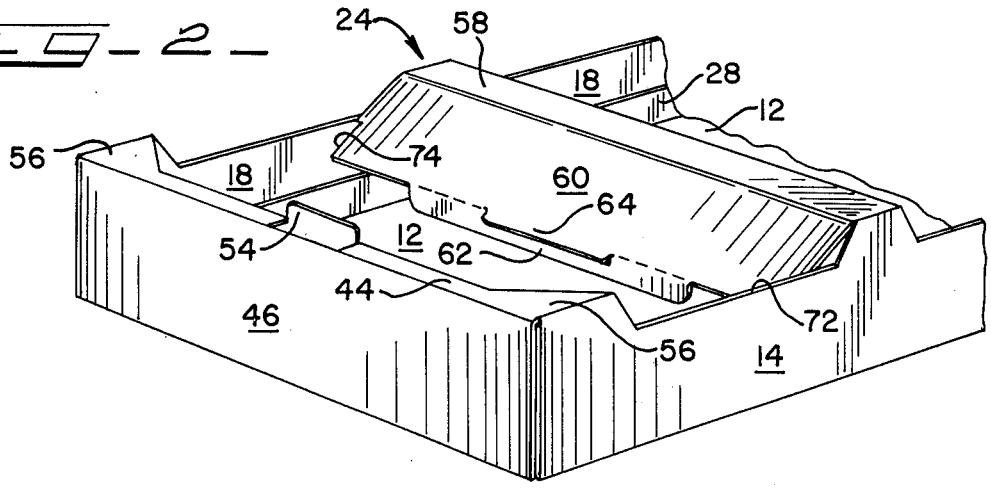
FIG. 2 is an enlarged partial view in perspective of a tray constructed in accordance with the invention and erected from the blank of FIG. 1, and shows an intermediate stage in the formation of the divider.

A divider is formed by folding lateral panels 60 toward bottom panel 12 about score lines 59 and by folding base flaps 62 toward one another about score lines 63. As previously noted, the latter step departs from previously known constructions in which the base flaps are folded in directions away from one another. At this juncture the nearly completed tray is substantially in the condition illustrated in FIG. 2. The divider, and thus the tray, are completed by continuing to fold lateral panels 60 about score lines 59 until locating tabs 64 are securely received in locating slots 66 with base flaps 62 disposed between the lateral panels and adhered to bottom panel 12.

Figure 3:
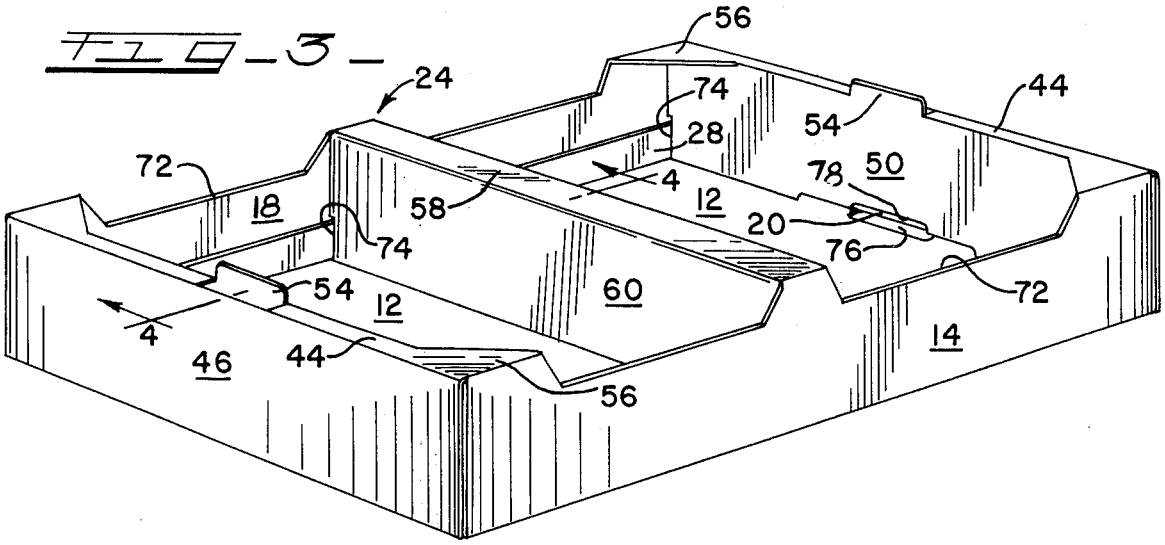
FIG. 3 is a view similar to FIG. 2 but represents the complete tray with the divider fully formed.
Figure 4:
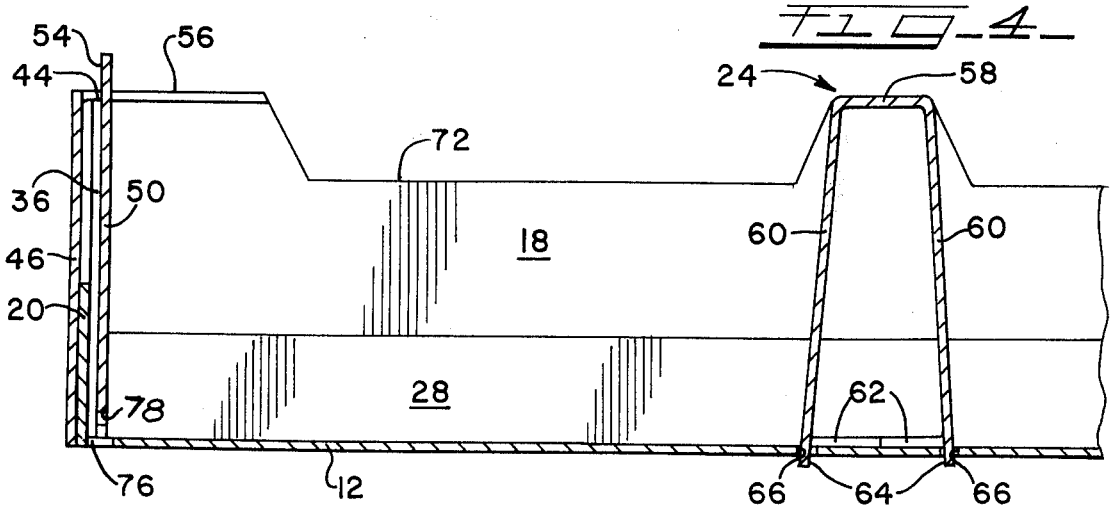
FIG. 4 is a further enlarged, partial sectional view in elevation of the tray of FIG. 3 taken along line 4—4 thereof.

The completed tray is represented in FIGS. 3 and 4. It will be apparent that a bottom wall of the tray is provided by bottom panel 12, a pair of opposed side walls by side panels 14 and 18 (the latter in cooperation with side flap 28), and a pair of opposed and end walls by intermediate end panels 20, end flaps 32 and 36, and end panel structures 40.

The divider provided by divider panel means 24 separates the interior of the tray into two adjacent compartments. More particularly, central panel 58 bridges the tray side walls, lateral panels 60 extend downwardly to the bottom wall from opposite sides of the central panel, and base flaps 62 each extend toward the other from a respective one of the lateral panels at a lower side thereof adjacent to the bottom wall, the base flaps engaging the bottom wall to provide a base of the divider disposed entirely between the lateral panels.

In the ensuing discussion, and throughout this specification, the term "width" is used to refer to the transverse dimension according to the proportions or relative dimensions shown in the drawings, which are most clearly represented in FIG. 1. Similarly, the term "longitudinal" is used to refer to the lengthwise dimension according to the proportions shown. In like manner, the term "end" is used to refer to one of the two narrower sides of an element, and the term "side" to refer to one of the two longer sides thereof, again according to the proportions shown. However, these terms are used simply for orientation purposes in establishing the direction of measurement or reference, and the invention is by no means limited to such proportions. Accordingly, if significant departures were made from the relative dimensions shown in the drawings, it is entirely possible that "width," as used herein, might refer to the longitudinal dimension, "longitudinal" to the transverse dimension, "end" to a longer side, and "side" to a narrower side.

If, as in the illustrated embodiment, base flaps 62 are directly opposed to one another, it will be apparent that the sum of their widths should not be greater than the distance between locating slots 66 in the longitudinal direction relative to bottom panel 12. Obviously, if the sum of their widths were to exceed such distance, the base flaps would overlap and their adhesion to the bottom wall of the tray would be affected.

It follows that if the widths of base flaps 62 are identical, also as in the illustrated embodiment, their common width should not be greater than one half such longitudinal distance.

These restrictions on the widths of the base flaps are not essential to the invention in its broader aspects since the base flaps might, for example, be offset from one another. In such a case, the width of each base flap may be as great as the longitudinal distance between the locating slots.

In the illustrated embodiment, lateral panels 60 are shown to be identical whereby the divider is symmetrical in cross section, as best represented in FIG. 4. While this construction is preferred, it is within the purview of the invention that the width of one lateral panel be greater than that of the other. In a similar connection, the width of each lateral panel is shown to be greater than the maximum height of the side walls of the tray (that is, the maximum width of each of side panels 14 and 18), whereby the divider is symmetrically trapezoidal in cross section. It may be desirable, however, that the divider be rectangular in cross section, to better accommodate baskets having directly upright side walls for example. In such a case, the width of each lateral panel may be made equal to the maximum height of the side walls.

While it is not essential to the invention that base flaps 62 be adhered to the bottom wall of the tray, as by the adhesive mentioned hereinabove, such a feature is preferred because it prevents the divider from unfolding and acts to prevent the bottom wall from sagging under the weight of the contents of the tray.

It will be apparent that the widths of central panel 58 and lateral panels 60 and the longitudinal distance between locating slots 66 are interrelated. Preferably the longitudinal distance is at least equal to the width of central panel 58 so that there will be no interference between locating tabs 64 and the central panel of a similar tray directly subjacent in a stack of trays. In combination with such a feature, it is even more preferable that the width of each locating tab be greater than the thickness of the material of the tray, whereby portions of the locating tabs will protrude from the lower face of the bottom wall, as shown in FIG. 4, and straddle the central panel of the directly subjacent tray to assist stacking and to act to prevent relative longitudinal movement between adjacent trays in a stack thereof.

Trays constructed as shown and described herein are especially well adapted to be stacked to relatively great heights even when filled with densely packed fruit. Central panel 58 and upper end panels 44, which preferably lie in a common plane, present horizontal load-bearing or load-distributing surfaces, while lateral panels 60 and end panels 20, 46 and 50 provide vertical structural support. Obviously, if the material of the tray is corrugated fibreboard, the corrugated flutes should be parallel with the vertical, referring to FIGS. 1 and 4, in order to achieve optimum compressive strength. Brace areas 56 of the upper end panels enhance the rigidity of the corners formed by the side walls and end walls.

If the tray is to bear printing, the face of blank 10 visible in FIG. 1 should be the face printed upon since it comprises all exterior surfaces of the tray, including those of the divider, and also the interior surfaces of the end walls.

A tray having more than two compartments can be provided by elongating the blank in the vertical direction as viewed in FIG. 1 and by providing additional divider panel means 24.

Other features of the blank and tray may include, referring particularly to FIG. 1, ventilating openings 70 formed in bottom panel 12, some of which may interrupt score lines 16 and 30, as shown, to facilitate folding; ventilating crenellations 72 in side panels 14 and 18, which interrupt score lines 26 and **26*a* to similar effect; indentations 74 which accommodate side flap 28 when the tray is erected and which are formed in those edges of inner end panels 50 and lateral panels 60 which are adjacent to side panel 18; a pair of stacking slots 76 each disposed adjacent to one of score lines 22 for receiving the stacking tabs 54 of a similar, directly subjacent tray to prevent relative movement between adjacent trays in a stack thereof; and a cutout 78 in the side of each inner end panel 50 opposite score line 52, cutouts 78 being so dimensioned and disposed as to accommodate the upper portions of stacking tabs received in stacking slots 76.**

Although the invention has been described with reference to trays for receiving baskets of fruit, it will be apparent that it will readily find other useful applications; for example, in trays formed of paperboard for containing and displaying small pastries, candies and the like.

Accordingly, while the invention has been particularly described in connection with a certain specific embodiment thereof, it is to be understood that this is by way of illustration and not of limitation, and that the scope of the appended claims should be construed as broadly as the prior art will permit.

What is claimed is:

1. A blank for forming a tray having at least two compartments, comprising a plurality of panels, adjacent ones of the panels being hingedly interconnected, the panels being provided by a bottom panel for forming a bottom wall of the tray, a pair of side panels spaced from one another for forming opposed side walls of the tray, a pair of end panels spaced from one another for forming opposed end walls of the tray, and divider panel means for forming a divider separating adjacent compartments of the tray, the divider panel means comprising a central panel bridging the side panels, a pair of lateral panels extending from opposite sides of the central panel, a pair of base flaps each hingedly extending from a respective one of the lateral panels at a side thereof opposite the central panel, and a pair of locating tabs each projecting from a respective one of the lateral panels at said side thereof, the bottom panel having formed therein a pair of locating slots spaced from one another and each disposed to receive a respective one of the locating tabs when a tray is erected from the blank, the sum of the widths of the base flaps being not greater than the distance between the locating slots in the longitudinal direction relative to the bottom panel.

2. A blank as defined in claim 1, wherein the widths of the base flaps are substantially identical, whereby the width of each base flap is not greater than one half said longitudinal distance between the locating slots.

3. A blank as defined in claim 1, wherein said longitudinal distance between the locating slots is at least equal to the width of the central panel.

4. A blank as defined in claim 3, wherein the width of each locating tab is greater than the thickness of the material of the blank.

5. A blank as defined in claim 1, wherein each locating tab comprises a cutout portion of the respective base flap.

6. A blank as defined in claim 1, wherein the side walls are substantially identical, and the width of at least one of the lateral panels is greater than the maximum width of the side panels.

7. A blank as defined in claim 1, having an adhesive applied to one face of each of the base flaps.

8. A tray formed from a blank therefor and having at least two compartments, comprising a bottom wall, a pair of opposed side walls, a pair of opposed end walls, and a divider separating adjacent compartments, the divider comprising a central panel disposed above the bottom wall and bridging the side walls, a pair of lateral panels extending downwardly to the bottom wall from opposite sides of the central panel, a pair of base flaps each extending toward the other from a respective one of the lateral panels at a lower side thereof adjacent to the bottom wall, the base flaps engaging the bottom wall to provide a base of the divider disposed between the lateral panels, and a pair of locating tabs each projecting from a respective one of the lateral panels at said lower side thereof, the bottom wall having formed therein a pair of locating slots spaced from one another, each of the locating tabs being received in a respective one of the locating slots.

9. A tray as defined in claim 8, wherein the sum of the widths of the base flaps is not greater than the distance between the locating slots in the longitudinal direction relative to the bottom wall.

10. A tray as defined in claim 9, wherein the widths of the base flaps are substantially identical, whereby the width of each base flap is not greater than one half said longitudinal distance between the locating slots.

11. A tray as defined in claim 10, wherein the lateral panels are substantially identical, whereby the divider is symmetrical in cross section.

12. A tray as defined in claim 9, wherein said longitudinal distance between the locating slots is at least equal to the width of the central panel.

13. A tray as defined in claim 12, wherein the width of each locating tab is greater than the thickness of the material of the tray, whereby portions of the locating tabs protrude from a face of the bottom wall opposite the face thereof engaged by the base flaps, and are disposed to straddle the central panel of a similar, directly subjacent tray.

14. A tray as defined in claim 8, wherein the base flaps are fastened to the bottom wall.

15. A tray as defined in claim 8, wherein the base flaps are adhered to the bottom wall by means of an adhesive.

16. A tray as defined in claim 8, wherein each locating tab comprises a cutout portion of the respective base flap.

17. A tray as defined in claim 8, wherein the width of at least one of the lateral panels is greater than the maximum height of the side walls, whereby the divider is trapezoidal in cross section.

18. A tray as defined in claim 8, wherein the lateral panels are substantially identical, and the width of each lateral panel is greater than the maximum height of the side walls, whereby the divider is symmetrically trapezoidal in cross section.

* * * * *